US006813921B2

(12) United States Patent
Hall et al.

(10) Patent No.: US 6,813,921 B2
(45) Date of Patent: Nov. 9, 2004

(54) METHOD FOR ROLLING METAL MATERIAL INTO A METAL STRIP

(75) Inventors: Dan Hall, Powell, OH (US); Ilpo Koppinen, Pori (FI); George Mayer, Delaware, OH (US); Brian Swank, Marengo, OH (US)

(73) Assignee: Outokumpu Oyj, Espoo (FI)

( * ) Notice: Subject to any disclaimer, the term of this patent is extended or adjusted under 35 U.S.C. 154(b) by 130 days.

(21) Appl. No.: 10/199,659

(22) Filed: Jul. 19, 2002

(65) Prior Publication Data

US 2004/0011108 A1 Jan. 22, 2004

(51) Int. Cl.[7] ..... B21B 1/18
(52) U.S. Cl. ..... 72/234; 72/366.2
(58) Field of Search ..... 72/234, 366.2, 72/377, 252.5, 204, 365.2

(56) References Cited

U.S. PATENT DOCUMENTS

| | | | | |
|---|---|---|---|---|
| 2,371,671 A | * | 3/1945 | Blount et al. | 72/366.2 |
| 4,233,832 A | | 11/1980 | Rowell | |
| 4,276,763 A | * | 7/1981 | Schmitz | 72/234 |
| 4,793,169 A | | 12/1988 | Ginzburg | |

* cited by examiner

*Primary Examiner*—Lowell A. Larson
(74) *Attorney, Agent, or Firm*—Morgan & Finnegan, L.L.P.

(57) ABSTRACT

The invention relates to a method for rolling a metal profile into a metal strip in which method the technique of a profiled rolling in combination with a strip rolling is used, comprising that during the at least two-staged profiled rolling the metal rod is divided into two symmetrical segments. These segments are spread into the lateral regions of the material to be rolled into a flattened profile which is as an object for at least one-staged strip rolling so that the spread ratios between the diameter of the rod and the width of the strip of greater than 2,8:1 are achieved.

14 Claims, 3 Drawing Sheets

METHOD FOR ROLLING METAL MATERIAL INTO A METAL STRIP

Figure 1:
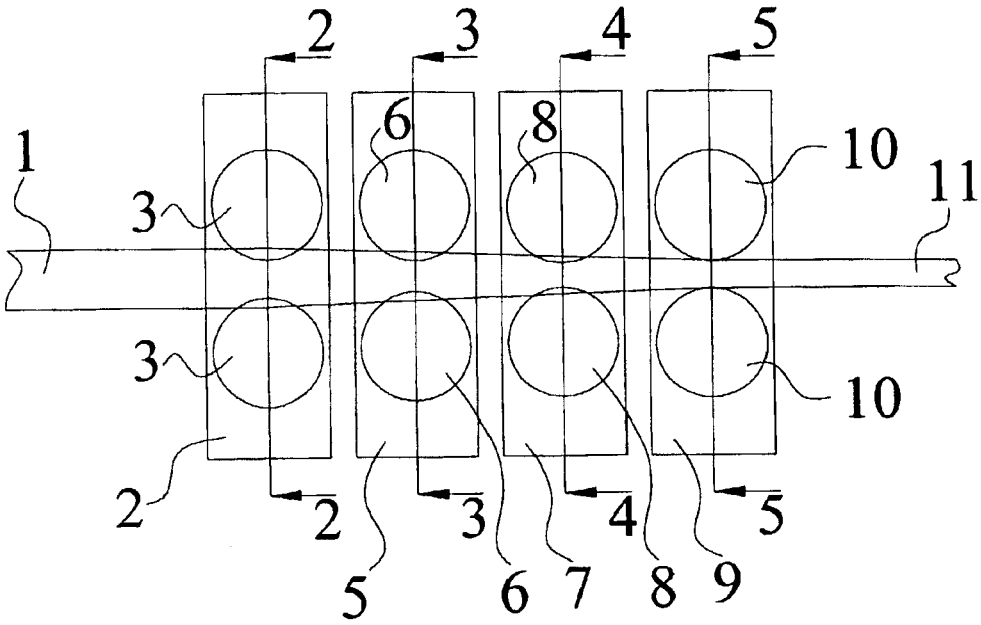

This invention relates to a method for rolling a metal profile into a metal strip.

Of all the rolling operations, strip rolling is the most common. More strip rolling is preformed than all other rolling operations put together. The conventional process for producing a metal strip is limited to small coils or requires welding of the coil ends together in order to obtain a large coil weight. In general, the process conditions for producing a metal strip are such that the incoming material has a greater thickness and width than the desired strip. During the rolling process the reduction of the strip is taken with respect to the side having the largest surface area. For the production of a metal strip, the reduction is made to the overall thickness. Depending on the incoming material geometry, the percent of lateral spread is dependent upon the diameter of the work roll and the type of lubrication used.

In the case of rolling a metal rod into a metal strip, the final strip width is dependent upon the work roll diameter, lubrication, and the diameter of the rod. The current limiting factors for processing a metal rod into a metal strip are the small spread ratios (width/diameter) and controlling the edge variation. With small spread ratios the ability to produce a wide metal strip from a metal rod becomes marginally feasible due to the size of the equipment needed. Also as the diameter of the rod increases so does the amount of the edge variation encountered in the process. When considering a process for manufacturing a metal strip from a metal rod, the easiest approach is to do a direct reduction of the rod and obtain a given width. Normally the width of the metal strip (i.e. copper) processed by the direct reduction method has a spread ratio of 1.7:1–1.9:1. By simply striking a line across the diameter of a rod and multiplying it by 1.7 a final strip width can be determined. In order to achieve higher spread ratios from a given diameter of rod, it is necessary to find a method that will extend the initial line length through the rod. The theoretical maximum width that can be achieved from a rod is obtained by striking a helical arc through the material. If the rod were to be uncoiled about the arc the theoretical maximum width of strip could be achieved for a given thickness. Although this would produce the maximum width of strip there are fundamental problems preventing this process from being exploited.

From the U.S. Pat. No. 4,793,169 it is known a continuous rolling mill in which a thin slab from a continuous caster can be processed to a strip through the hot rolling mill without interruption. In one embodiment of this U.S. Pat. No. 4,793,169 billets or shapes having curved cross sections such as rounds and ovals may be rolled. The work rolls have complementary, diverging work surfaces, each beginning with a narrow region at the midpoint of the roll and diverging to a wider region extending across the width of the roll. When the wider regions come into contact with the material, the roll gap is relieved and the rolled material is partially retracted in a back pass. The roll gap is again closed and the narrow region again contacts the material to further the flattening and spreading, eventually to produce the strip. While this process can make wide strip its through-put is relatively low and the mechanism to make such a motion complex compared to the conventional rolling mill.

The U.S. Pat. No. 4,233,832 describes a method and apparatus for rolling a metal wire or rod into a wide, flat strip. In this method, the metal wire or rod is passed between two rolls one inside the other but with offset axes. The larger outer roll, which may be ring-shaped has a smooth inside contact surface. The smaller internal roll has a smooth outside contact surface. The opposing, smooth surfaces have a separation at the closest point, which is less than ⅓ the diameter of the metal wire or rod to be fed between them. The distance between the point, where the wire first contacts the opposing, smooth contact surfaces of the converging throat and the closest point of separation between the opposing surfaces is preferred to be at least four times the original diameter of the wire or rod being fed there through. Rolling of metal wire or rod in this manner produces a wide, flat metal strip having a width of at least 2.5 times the original diameter of the wire or rod, and the resultant strip width may considerably exceed 4.0 times the original diameter. As an example for the U.S. Pat. No. 4,233,832 it is mentioned a wire of nominally pure lead having a diameter of 0.190 of an inch (4.8 mm) was flattened into a strip having a width of approximately 1 inch. This represents a width to diameter ratio of approximately 5.3.

In both referred U.S. patents the rolling for a flattened strip is carried out in a single rolling stage. This requires that the devices and especially the surfaces of the work rolls are well manufactured. Also the maintenance of the devices and the rolls is very difficult in order to keep the tolerance continuously between the rolls essentially the same for instance because of the quality requirements of the strip.

Given the limitations of the conventional process, new methods for producing strip in long lengths and with reduced variable costs is of high importance. By combining the techniques of strip and profile rolling new methods for producing narrow and wide strip can be developed to meet these demands.

The object of the present invention is to overcome the current limitation in the spread ratio and the edge variation of rolling a metal profile into a metal strip and to achieve a method for rolling a metal profile into a metal strip in which method the technique of a profiled rolling in combination with a strip rolling is used. The essential features of the invention are enlisted in the appended claims.

According to the invention the longitudinal and lateral spread of the material to be rolled advantageously in a shape of a metal rod or a similar profile for a metal strip are influenced by creating a special geometry to the rod prior to rolling it into the strip. The material to be rolled is advantageously divided into two symmetrical segments and maintained as two equal segments until it is rolled to a flattened strip.

In the initial rolling operation the material to be rolled is split into two symmetrical segments using an approach that is similar to driving a wedge into a piece of wood. The bulk displacement of the material to be rolled is in the lateral direction due to the relative resistance encountered. The longitudinal elongation with this approach can be maintained below 5%. After the material to be rolled has been divided into two equal segments, the profiled rolls in the following operations force the bulk movement of the material to be rolled laterally. With low losses of the material to be rolled in the longitudinal direction, spread ratios (width/diameter) between the width of the strip and the diameter of the material to be rolled of greater than 2.8:1 are achieved.

In the method of the invention the material to be rolled is rolled into a flattened strip by a multistage rolling where at least two stages from the start are based on the profile rolling following at least one stage of the strip rolling. The rolls for the stages of the profile rolling are shaped so that the rolling effect is focused on the material to be rolled in its center part so that the center part of the material to be rolled divides the material to be rolled material to two symmetrical lateral parts having a thickness greater than the center part of the material to be rolled material.

The material to be rolled is centered so that the material to be rolled is fed in its center part to the point of the gap between the rolls where the distance between the rolls is the shortest. Thus the rolling advantageously starts from the thickest part of the material to be rolled.

In one preferred embodiment of the invention the rolls for the first stage rolling are so shaped that the rolling effect is focused to the center part of the material to be rolled. This is carried out so that the surface of the center part of one of the working rolls is convex curved. The curved center part of the roll surface is connected at both ends with the surface of the lateral parts of the roll, which are essentially linear and are directed divergently from the center part of the roll. Thus the two rolls are at the closest to each other at the center point of the rolls. The curved part of the roll is between 20 and 35% of the total width of the roll surface. The surfaces of the lateral parts of the roll form a sharp angle of between 40 and 60 degrees against the rolling plane. Thus the material to be rolled is able to spread towards the lateral regions. The surfaces in the lateral parts of the roll can also be curved if the curves are mainly directed divergently from the center part of the roll.

In the second stage for the profile rolling the roll is shaped so that the convex curved part of the roll in the center part is wider than in the first stage of the profile rolling. Thus the area where the material to be rolled has a mechanical contact with the surfaces of the rolls is also wider and the material is further spread in its lateral regions. The lateral regions of the surface of the roll starting from both ends of the curved center part of the surface of the roll will be linear or curved so that the lateral regions are directed divergently from the center part of the roll.

In another preferred embodiment of the invention the rolls for the first stage rolling are asymmetrical so that the rolling effect is focused to the center part of the material to be rolled. This is carried out so that the surface of the center part of one roll is convex curved while another roll is concave curved. The convex curved center part of the roll surface is between 5 and 20% of the total width of the roll surface. This convex curved center part of the roll surface is connected at both ends with the surface of the lateral parts of the roll, which are concave curved and are directed divergently from the center part of the roll. The concave curved roll is concave curved at least 90% of the total width of roll surface which roll surface is narrower than or equal to the roll surface of the roll having the center part convex curved. Based on the shapes of the rolls the two rolls are still at the closest to each other at the center point of the rolls. Thus the material to be rolled is able to spread towards the lateral regions.

In the second rolling stage the working roll positioned in a respective manner to the roll having the center part convex curved in the first rolling stage is still convex curved in the center part but the convex center part is larger than in the first rolling stage. The convex curved part is between 20 and 35% of the total width of the roll surface. The convex curved center part of the roll surface is connected at both ends with the surface of the lateral parts of the roll, which are essentially linear and are directed divergently from the center part of the roll. The surfaces of the lateral parts of the roll advantageously form a sharp angle of between 40 and 60 degrees against the rolling plane. The counter working roll for the convex curved roll is in the second stage advantageously essentially flat and the width of the roll surface is essentially equal to the roll surface of the convex curved roll. Thus also in this stage the material to be rolled is able to spread towards the lateral regions.

In the third rolling stage the convex curved working roll is convex curved essentially in the total width of the roll surface. The counter working roll for the convex curved roll is in this stage advantageously essentially flat and the width of the roll surface is advantageously larger than the roll surface of the convex curved roll. The two working rolls are still at the closest to each other at the center point of the rolls and, therefore, the spreading of the material to be rolled towards the lateral regions will continue in this third stage.

Despite of the embodiments described above when the desired width of the strip is achieved the rolling stage or stages will concentrate to the thickness of the rolled strip and thus the rolling surfaces between two working rolls are parallel and the gap between two working rolls is essentially the same for the whole width of the rolling surfaces.

Figure 2:
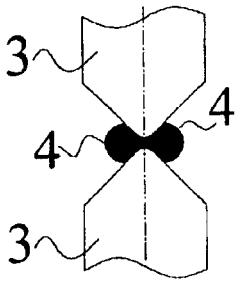
Figure 3:
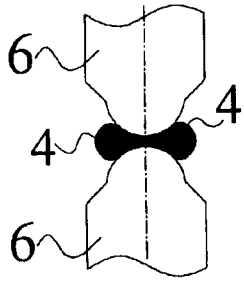
Figure 4:
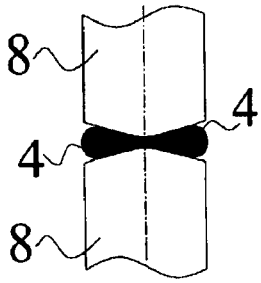
Figure 5:
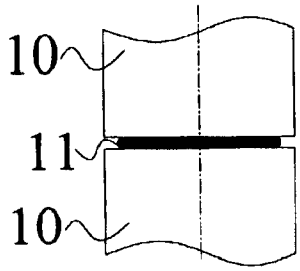
Figure 6:
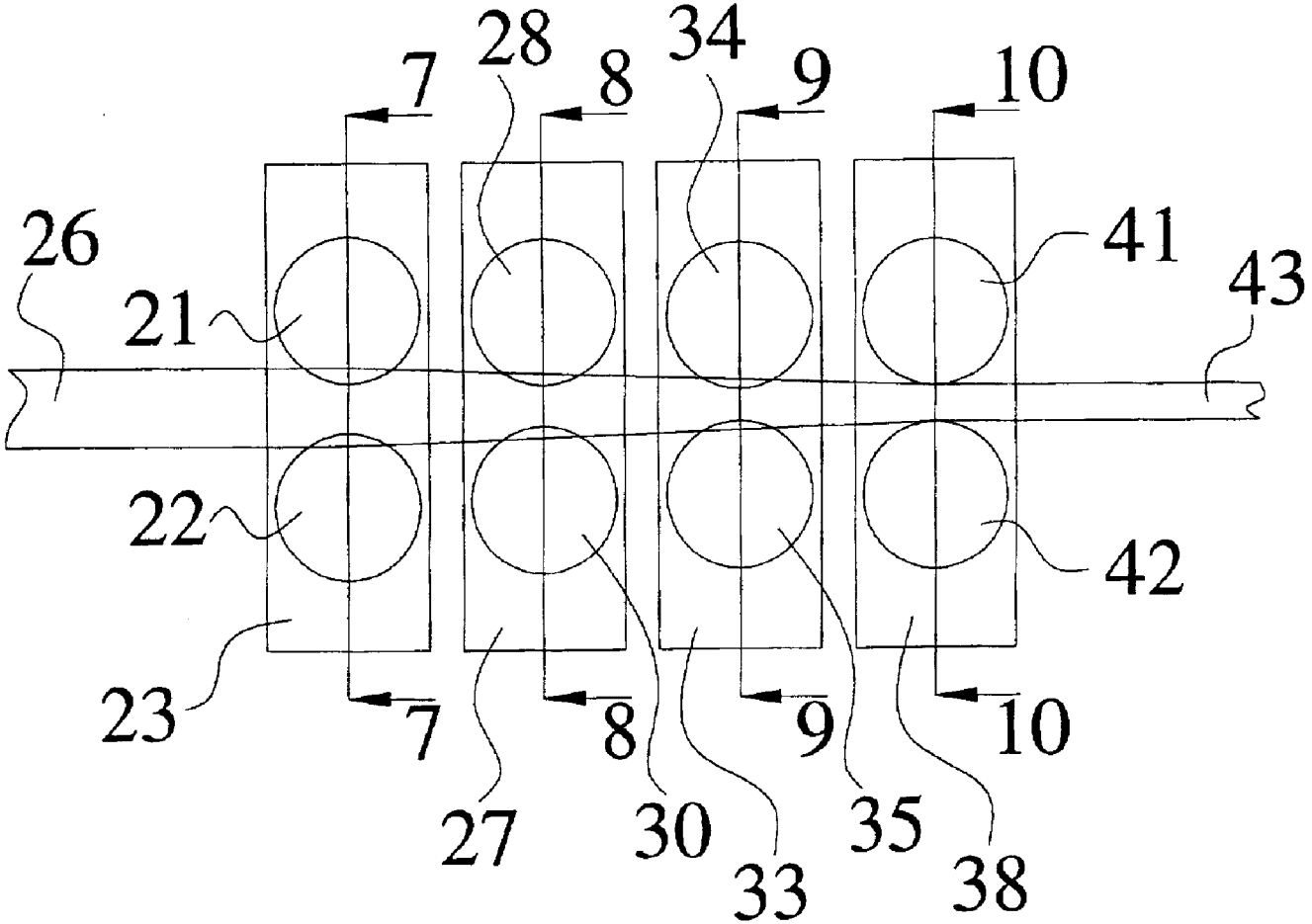
Figures 7, 8, 9, 10:
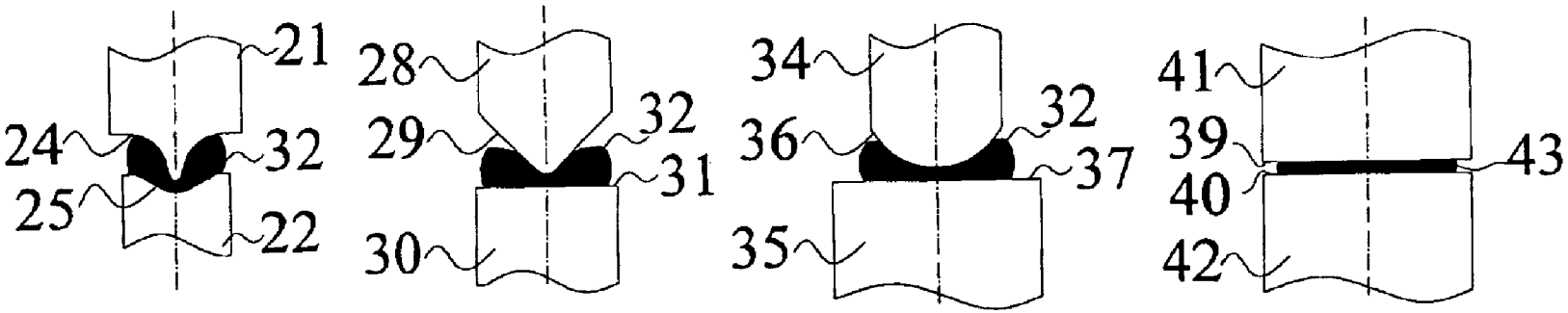

The invention is described in more details referring to following drawings where FIG. 1 illustrates a schematical side-view of the preferred embodiment of the invention, FIG. 2 illustrates the embodiment of FIG. 1 from the direction 2—2, FIG. 3 illustrates the embodiment of FIG. 1 from the direction 3—3, FIG. 4 illustrates the embodiment of FIG. 1 from the direction 4—4, FIG. 5 illustrates the embodiment of FIG. 1 from the direction 5—5, FIG. 6 illustrates a schematical side-view of another preferred embodiment of the invention, FIG. 7 illustrates the embodiment of FIG. 6 from the direction 7—7, FIG. 8 illustrates the embodiment of FIG. 6 from the direction 8—8, FIG. 9 illustrates the embodiment of FIG. 6 from the direction 9—9, FIG. 10 illustrates the embodiment of FIG. 6 from the direction 10—10.

According to the FIGS. 1 to 5, the rod material 1 to be rolled is fed to the first profile rolling stage 2 where the work rolls 3 are so shaped that the rolls 3 have the first contact with the rod material 1 in the center part of the rod material 1. The rolls 3 divide the rod material 1 into two symmetrical segments 4 as shown in FIG. 2. The working rolls 3 are so shaped that the distance between the rolling surfaces of the rolls 3 increases from the center part towards the lateral parts of the rolls 3. Therefore the segments 4 have space to spread into the lateral directions.

After the first profile rolling 2 the material to be rolled 1 is fed into the second profile rolling stage 5 where the rolling effect is still focused into the center part of the material 1, but now for a wider region than in the first profile rolling stage 2. The working rolls 6 in the second profile rolling stage 5 are so shaped that the distance between the rolling surfaces of the rolls 6 is the shortest in the center part and the distance in the center part is essentially similar to the distance between the working rolls 3 in the first profile rolling stage 2. However, the region in the working rolls 6, which have mechanical contact with the material 1 to be rolled, is wider. Thus the rolls 6 spread the material 1 more and more towards the lateral regions where the segments will be changed so that the width of segments 4 will increase at the expense of the thickness of the material 1 which is still thicker than in the center part.

The material 1 to be rolled is further transferred into the third profile rolling stage 7 where the distance between the working rolls 8 is in the center part of the rolling surface essentially the same as in the preceding rolling stages 2 and 5. The distance between the working rolls 8 will increase towards the lateral regions of the rolling surfaces, but the contact between the working rolls 8 and the material 2 is at least 80% of the width of the rolling surfaces of the working rolls 8. Because the material 2 to be rolled has space in the lateral regions to spread, the width of the material 1 will increase accordingly.

After the third profile rolling stage 7 the material 1 to be rolled is flattened so much that the material 1 is ready for a strip rolling stage 9 as shown in FIG. 5. In the strip rolling stage 9 the rolling surfaces of the working rolls 10 are in the essentially same distance from each other at their total width. The mechanical contact between the rolling surfaces of the working rolls 10 and the material 1 is then created for the whole width of the strip 11. The width of the strip 11 is about 3 times the diameter of the original rod material 1 fed into the method of the invention.

In the other preferred embodiment of the invention illustrated in FIGS. 6–10 the the work rolls 21 and 22 are so shaped that the rolls 21 and 22 have the first contact with the rod material 26 in the center part of the rod material 26. The rolls 21 and 22 divide the rod material 26 into two symmetrical segments 32 as shown in FIG. 7. The rolls 21 and 22 for the first rolling stage 23 are so shaped that the surface of the center part of one roll 21 is convex curved while another roll 22 is concave curved. The convex curved center part of the roll surface 24 in the roll 21 is between 5 to 20% of the total width of the roll surface 24. This convex curved center part of the roll surface 24 is connected at both ends with the surface of the lateral parts of the roll 21, which are concave curved and are directed divergently from the center part of the roll. The concave curved roll 22 is concave curved at least 90% of the total width of roll surface 25 which roll surface 25 is narrower than or equal to the roll surface 24 of the roll 21. Based on the shapes of the rolls 21 and 22 the rolls 21 and 22 are still at the closest to each other at the center point of the roll surfaces 21 and 22. Thus the segments 32 of the material 26 to be rolled is able to spread towards the lateral regions.

In the second rolling stage 27 the rolling effect is still focused into the center part of the material 26, but now for a wider region than in the first profile rolling stage 23. The roll 28 positioned in respective manner to the roll 21 having the center part convex curved in the first rolling stage 23 is still convex curved in the center part but the convex center part is larger than in the first rolling stage 23. The convex curved center part of the roll 28 is 25% of the total width of the roll surface 29. The convex curved center part of the roll surface 29 is connected at both ends with the surface of the lateral parts of the roll 28, which are essentially linear and are directed divergently from the center part of the roll 28. The surfaces of the lateral parts of the roll 28 advantageously form a sharp angle of at least 45 degrees against the rolling surface. The counter roll 30 for the convex curved roll 28 is in the second stage advantageously essentially flat and the width of the roll surface 31 of the roll 30 is essentially equal to the roll surface 29 of the convex curved roll 28. Thus also in this stage the material 26 to be rolled is able to spread more and more towards the lateral regions of the roll surfaces 29 and 31. Then the segments 32 of the material 26 to be rolled will be changed so that the width of segments 32 will increase at the expense of the thickness of the material 26 which is still thicker than in the center part.

In the third rolling stage 33 the working rolls 34 and 35 are so shaped that the rolling effect is still focused into the center part of the material 26 and the material 26 to be rolled has space in the lateral regions to spread. One of the working roll 34 positioned in respective manner as the rolls 21 and 28 in the previous stages to the material 26 to be rolled is convex curved essentially in the total width of the roll surface 36. The counter roll 35 for the convex curved roll 34 is in this stage advantageously essentially flat and the width of the roll surface 37 is advantageously larger than the roll surface 36 of the convex curved roll 34. The two working rolls 34 and 35 are still at the closest to each other at the center point of the rolls 34 and 35 and, therefore, the spreading of the material to be rolled towards the lateral regions will continue in this third stage 33.

After the third profile rolling stage 33 the material 26 to be rolled is flattened so much that the material 26 is ready for a strip rolling stage 38 as shown in FIG. 10. In the strip rolling stage 38 the rolling surfaces 39 and 40 of the working rolls 41 and 42 are in the essentially same distance from each other at their total width. The mechanical contact between the rolling surfaces 39 and 40 of the working rolls 41 and 42 and the material 26 is then created for the whole width of the strip 43. The width of the strip 43 is about 3 times the diameter of the original rod material 26 fed into the method of the invention.

What is claimed is:

1. Method for rolling a metal profile into a metal strip using profiled rolling in combination with strip rolling, the method comprising:

dividing a metal rod into two symmetrical segments by profiled rolling with working rolls having a curved middle portion;

spreading the two symmetrical segments into lateral regions of material by profiled rolling with working rolls having a curved middle portion;

flattening the two symmetrical segments into a bar having a flattened profile; and strip rolling, in at least one stage, so that a spread ratio between a width of the bar and a diameter of the rod is greater than 2.8:1.

2. Method according to claim 1, further comprising feeding the rod, in each rolling stage, into a gap between two working rolls.

3. Method according to claim 2, further comprising:

utilizing separate rolling devices for profiled rolling and for strip rolling.

4. Method according to claim 2, wherein a rolling surface of a first working roll of each rolling stage is substantially identical to a second working roll in the same stage.

5. Method according to claim 2, wherein a rolling surface of a first working roll of each profiled rolling stage is asymmetrical to a second working roll in the same stage.

6. Method according to claim 1, further comprising:

arranging the profiled rolling stages and the strip rolling stage in separate rolling devices.

7. Method according claim 6, wherein a rolling surface of a first working roll of each rolling stage is substantially identical to a second working roll in the same stage.

8. Method according to claim 6, wherein a rolling surface of a first working roll of each profiled rolling stage is asymmetrical to a second working roll in the same stage.

9. Method according to claim 1, wherein a rolling surface of a first working roll of each rolling stage is substantially identical to a rolling surface of a second working roll in the same stage.

10. Method according to claim 9, wherein rolling surfaces of the working rolls in profiled rolling stages are in cross-section, at their center parts, convex curved.

11. Method according to claim 1, wherein a rolling surface of a first working roll of each profiled rolling stage is asymmetrical to a second working roll in the same stage.

12. Method according to claim 1, wherein the shortest distance between rolling surfaces of each pair of working rolls in each profiled rolling stage are substantially equal.

13. Method according to claim 1, further comprising:

increasing a mechanical contact area between the material being rolled and rolling surfaces of the working rolls stage by stage during profiled rolling.

14. Method according to claim 1, wherein rolling surfaces of the working rolls in profiled rolling stages are, in cross-section, at least partly curved.

* * * * *